United States Patent [19]

Hipon et al.

[11] Patent Number: 5,029,753

[45] Date of Patent: Jul. 9, 1991

[54] GARAGE DOOR MAIL DROP BOX

[76] Inventors: Francisco Hipon; Lau S. Wing, both of 2051 - 41st Ave., San Francisco, Calif. 94116

[21] Appl. No.: 447,820

[22] Filed: Dec. 8, 1989

[51] Int. Cl.[5] ..... A47G 29/12

[52] U.S. Cl. ..... 232/22; 232/45

[58] Field of Search ..... 232/22, 17, 19, 45, 232/39; 312/249, 293; 217/62; 248/27.1; 211/88

[56] References Cited

U.S. PATENT DOCUMENTS

| | | | |
|---|---|---|---|
| 757,698 | 4/1904 | Warner | 232/45 |
| 2,829,820 | 4/1958 | Evers | 232/45 X |
| 3,873,093 | 3/1975 | Beskrone | 312/293 X |
| 4,703,850 | 11/1987 | Walker | 232/22 X |
| 4,738,420 | 4/1988 | Angle et al. | 248/27.1 |

*Primary Examiner*—Blair M. Johnson

*Attorney, Agent, or Firm*—Douglas E. White

[57] ABSTRACT

A mail drop box includes four sides, a top and an open bottom, which together form a rectilinear sexahedron. A door on the top is slideably engaged in between a pair of opposed horizontally aligned channels for preventing the door from opening when the box is moved from a first vertical position to a second horizontal position. A plurality of brackets affix the box to a vertical surface, such as a garage door. Means for altering the height of at least portions of the sides are provided.

8 Claims, 1 Drawing Sheet

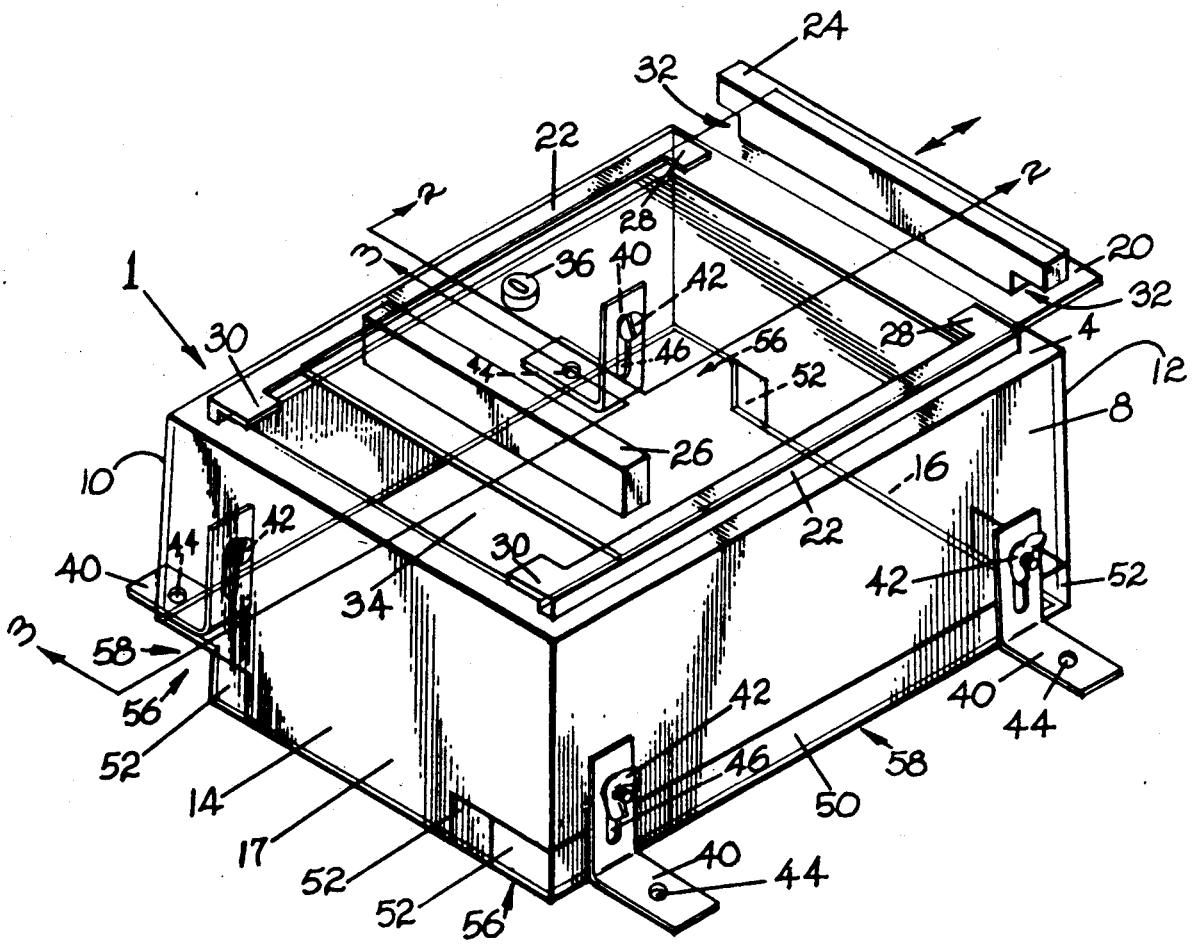

GARAGE DOOR MAIL DROP BOX

FIELD OF THE INVENTION

This invention relates to boxes for the receipt and storage of mail, more particularly to a drop box for catching mail inserted through a mail slot in an upwardly opening garage door.

BACKGROUND OF THE INVENTION

The vast majority of the residences and commercial buildings in this country have some means for receiving delivered mail. In many cases, this comprises a narrow slot communicating from the outside to the inside of the building. Very often, this slot is in a garage door or other door of the upwardly opening type, i.e. a door which is opened by being rolled or levered upward from a vertical position at the front wall of the garage until it hangs suspended in a horizontal position from the interior ceiling of the garage or other room.

Mail delivered through such garage door slots generally falls to the floor, where it is subject to becoming soiled. Furthermore, one must stoop over uncomfortably to retrieve it.

Prior developments in this field may be generally illustrated by reference to the following patents: Patent No. Patentee Issue Date 4,826,075 D. S. Burns May 02, 1989 3,991,934 R. D. Hamblin Nov. 16, 1976 3,389,854 L. Coopersmith Jun. 25, 1968 620,323, U.K. H. G. Ramsell May 18, 1949 1,207,684, France Skarsten Manufacturing Sep. 07, 1959 746,906 J. R. Wimer Dec. 15, 1903 511,722 J. J. Bisel Dec. 26, 1893 401,700 W. Graham Apr. 16, 1889

U.S. Pat. No. 4,826,075 shows a basket that hangs from a garage door mail slot and rotates when the door is raised so as to retain its contents.

U.S. Pat. No. 401,700 shows a rigid box affixed to a door. Since that door is of the side opening type, means for keeping the mail in the box is not needed - the mail drops into an open top.

U.S. Pat. No. 3,991,934, 3,389,854, U.K. 620,323 and French 1,207,684 teach letter plates that are incorporated into doors to form a letter drop.

The rest of the patents are representative of what is in the art.

The boxes of U.S. Pat. Nos. 4,826,075 and 401,700 are located below the slot and are not sealed to keep out dust and the like. If doors were simply added to the tops thereof, the mail could not enter. The box of the present invention has a feature not found in those references, namely a box which is mounted on top of the slot so that the mail feeds directly into the box. The door of the preferred box slides, whereas the provision of a hinged door like one shown, for example, in U.S. Pat. No. 3,389,854, would simply open when the garage door is lifted.

Summary of the Invention

The present invention is a garage door mail drop box which may be mounted so as to cover the mail slot in a upwardly opening garage door. The mail drop box has a sliding door on its top (which becomes the front when the box is mounted vertically) so that the mail does not drop out when the garage door is opened, and the mail drop rises with the door. At least the top (front, when mounted) of the mail drop is preferably made of a transparent material, such as plastic, so that the presence or absence of mail may be detected from afar.

Features and Advantages

An object of this invention is to provide a mail drop box which traps mail securely within its interior whether the box is in a vertical or a horizontal position. Accordingly, a box is disclosed which has a door that does not open when the box moves from vertical to horizontal.

A further object is to provide a box that readily reveals its contents and is attractive in appearance. Accordingly, a box made almost entirely of transparent plastic is described.

Yet another object is to provide a mail drop box which may be used in conjunction with garage doors of various profiles. The box of the present invention uses snap-off tabs and plates to allow the height or contour of the sides to be adjusted, as desired.

Another object is to provide an apparatus which is easy to use and suitable for mass production at relatively low cost. The device of the present invention meets these goals.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

Brief, Description of the Drawing

FIG. 1 is a perspective view of the mail drop box of this invention;

FIG. 2 is a broken sectional side elevation of the box, taken along line 2-2 of FIG. 1;

FIG. 3 is a broken sectional frontal elevation of the box, taken line 3-3 of FIG. 1;

FIG. 4 is a side elevation showing the box in a first vertical position mounted in a garage door environment, which environment is displayed in broken section; and FIG. 5 is a side elevation of the box in a second inverted horizontal position.

Drawing Reference Numerals 1 box 4 top of 1 8 front side of 1 10 rear side of 1 12 right side of 1 14 left side of 1 16 flange of 12 17 flange of 14 20 door 22 channels for 20 24 handle of 20 26 stop 28 right flanges of 22 30 left flanges of 22 32 undercut portions of 24 34 aperture in 4 36 lock 40 brackets 42 thumbscrews of 40 44 holes in 40 46 slots in 40 50 plates of 8, 10 52 tabs of 12, 14 56 undercut portions of 12, 14 58 undercut portions of 8, 10 60 garage door 62 cross pieces of 60 64 panel of 60 66 mail slot 70 mail

Description of a Preferred Embodiment

Referring to FIG. 1, there is illustrated therein a mail drop box 1 of this invention. Box 1 generally comprises top 4, front side 8, rear side 10, right side 12, left side 14 and door 20, combined together in a rectilinear sextahedron. The top becomes the "front" when the box is mounted in vertical orientation. The above parts are all preferably made of planar sheets of transparent plastic, in order that the contents of the box are readily visible. Alternatively, some parts may be opaque. At least the door 20, however, should be transparent. The bottom of the box is completely open until it is sealed by being installed flush up against a garage door, as discussed below.

The box door 20 is slideably mounted on the top 4 of the box 1 within longitudinal channels 22. The door may be grasped by the handle 24 and slid to the right to open the box and slid to the left to close it. When the door 20 is opened, a large rectangular aperture 34 in the top 4 is exposed, allowing access to the contents of the interior of the box 1.

The box, being symmetrical, may be mounted upside down so that the opening and closing directions are reversed. This is a useful feature in the case of those garage door/mail slot configurations wherein little room is available in one direction or the other for opening the box door 20.

A stop bar 26 is mounted on the end of the door that is opposite the handle 24. On opening, the stop will come to abut an opposed pair of inwardly directed right channel flanges 28 to prevent the door from being opened too far. On closing, the stop will come to abut an opposed pair of inwardly directed left channel flanges 30 to position the door properly upon closing. Undercut portions 32 of the T-shaped handle 24 allow it to pass beyond the flanges 28.

A lock 36 of conventional design, shown schematically in the drawing, may be incorporated in the door to prevent it from being opened by unauthorized persons.

A plurality of L-brackets 40, preferably four, are affixed to the box by means of thumbscrews 42, or the like, at appropriate positions. Here, the preferred box is shown with a pair of brackets on the rear side 10 and a matched pair on the front side 8. The brackets 40 could just as easily be mounted on the right and left sides 13, 14, or on all four sides. Holes 44 in the bottom legs of the brackets allow the box to be attached to a garage door with screws or nails. Vertical slots 46 in the brackets allow them to be adjusted according to height, which height may vary, as discussed in detail below.

Turning briefly to FIGS. 4 and 5, it can be seen that one type of garage door 60 has cross pieces or braces 62 that protrude outwardly from the flat panels 64 of the remainder of the garage door. Another type of garage door (not illustrated) has a completely flat profile.

In order to cover a mail slot 66 located in a panel of a garage door having a profile which is raised by cross pieces (which cross pieces are often spaced somewhat closely together) without leaving gaps out through which envelopes may slide, it is necessary to provide means for adjusting the height of the sides of the box so that its contour matches that of the door. At the same time, it is desired to provide a mail drop box which is also effective for flat profile garage doors (i.e. one whose sides are the same length throughout).

FIGS. 1–3 illustrate snap-off planar members that may be used to alter the shape of the sides of the box 1 according to the profile of the garage door. These planar members should have their outlines scored (continuously or intermittently) into the plastic of the sides down to a depth where they may easily be broken off. The front and rear sides 8, 10 have snap-off plates 50 running longitudinally their full lengths. The right and left sides 12, 14 each have a plurality of smaller snap-off tabs 52. Tabs 52 may share a common upper border, as illustrated, when cross-pieces 62 of only one height are expected. If varying heights of cross pieces may be encountered, then tabs 52 may be devised in which the height of the upper border may be varied.

If the garage door has a flat profile (no cross pieces), then the plates 50 and the tabs 52 will be left in place. This condition is shown in FIG. 1 with respect to the front side 8 and the front portions of the right and left sides 12, 14. However, for mounting on a garage door 60 having cross pieces 62, as shown in FIG. 4, the plates 50 will be removed, leaving undercut portions 58. Some or all of the tabs 52 will be removed, leaving undercut portions 56. This condition is shown in FIG. 1 with respect to the rear side 8 and the rear portions of the right and left sides 12, 14. The configuration of FIG. 1 might be used, for example, with a garage door having widely spaced cross pieces, but whose mail slot 66 pierces the door panel 64 very near to the upper cross piece.

Snapping off side tabs 52 to create undercut portions 56 forms downwardly protruding flanges 16, 17 on the right and left sides, respectively. These flanges create a lower side profile that mirrors the profile of the garage door and prevents mail 70 from escaping, as best seen in FIG. 4. The brackets are then adjusted upwardly from their positions shown in FIGS. 2 and 3 so that they may be screwed directly on top of the cross pieces.

FIG. 4 shows the box 1 mounted vertically in place on a garage door 60. Mail 70 may be inserted into the box from outside the garage door through the mail slot 66. The box door 20 is shut, causing all mail to be safely entrapped within the interior of the box. When the garage door 60 is opened by rolling or levering it upwardly into a horizontal position adjacent to the ceiling of the garage, as shown in FIG. 5, the mail 70 will shift within the box 1, but will not be allowed to exit until the box door 20 is opened. The box door may be opened to retrieve mail when the garage door is in either the vertical (closed) or horizontal (open) position.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, capacities, sizes, operational features or the like. For example, a hinged box door could be substituted for the sliding door of the preferred embodiment, provided that means is included for preventing the hinged box door from swinging open when the garage door is opened. Therefore, the above description and illustrations should not be construed as limiting the scope of the invention which is defined by the appended claims.

We claim:

1. A mail drop box including:

four sides, a top and an open bottom forming a rectilinear sextahedron;

a door on the top;

a plurality of L-brackets for affixing the box to a vertical surface;

means for altering the height of at least portions of the sides, the height altering means including snap-off planar members; and means for preventing the door from opening when the box is moved from a first vertical position to a second horizontal position, the preventing means including a pair of opposed horizontally aligned channels, in between which channels the door is slideably engaged, whereby the door only may be opened by sliding it in horizontal directions.

2. The apparatus of claim 1 wherein:

the door is made of transparent plastic.

3. The apparatus of claim 2 wherein:

the sides and the top are made of transparent plastic.

4. The apparatus of claim 3 wherein:

the brackets are adjustable according to the height of the portions of the sides whose height may be altered.

5. A mail drop box including:

four sides, a top and an open bottom forming a rectilinear sextrahedron;

a door on the top;

a plurality of adjustable L-brackets for affixing the box to a vertical surface;

a pair of opposed horizontally aligned channels, in between which channels the door is slideably engaged, for preventing the door from opening when the box is moved from a first vertical position to a second horizontal position; and means for altering the height of at least portions of the sides, the height altering means including snap-off planar members.

6. The apparatus of claim 5 wherein:

the door is made of transparent plastic.

7. The apparatus of claim 6 wherein:

the sides and the top are made of transparent plastic.

8. The apparatus of claim 7 further including:

a garage door of the type which opens from a vertical position to a horizontal position.

* * * * *